United States Patent [19]

Erni et al.

[11] Patent Number: 4,715,550

[45] Date of Patent: Dec. 29, 1987

[54] METHOD AND APPARATUS FOR CONTROLLING THE EFFECTIVE LENGTH OF THREAD PACKAGES

[75] Inventors: Markus Erni, Winterthur; Kurt Salvisberg, Gächlingen, both of Switzerland

[73] Assignee: Maschinen Abrik Rieter AG, Winterthur, Switzerland

[21] Appl. No.: 26,472

[22] Filed: Mar. 16, 1987

Related U.S. Application Data

[63] Continuation of Ser. No. 893,562, Aug. 5, 1986, abandoned, which is a continuation of Ser. No. 715,645, Mar. 21, 1985, abandoned.

[30] Foreign Application Priority Data

Mar. 22, 1984 [GB] United Kingdom ..... 8407465

[51] Int. Cl.[4] ..... B65H 63/08

[52] U.S. Cl. ..... 242/39; 242/36; 33/129

[58] Field of Search ..... 242/39, 36, 40, 49, 242/28, 30, 57; 57/78, 80, 81; 33/127, 129, 132 R, 132 A

[56] References Cited

U.S. PATENT DOCUMENTS

| | | | |
|---|---|---|---|
| 3,739,996 | 6/1973 | Matsui et al. | 242/39 |
| 3,860,185 | 1/1975 | Makino et al. | 242/39 X |
| 3,988,879 | 11/1976 | Franzolini et al. | 242/39 X |
| 4,024,645 | 5/1977 | Giles | 33/129 |
| 4,315,607 | 2/1982 | Felix | 242/39 X |
| 4,373,266 | 2/1983 | Stutz | 33/129 |
| 4,447,955 | 5/1984 | Stutz et al. | 242/39 X |

FOREIGN PATENT DOCUMENTS

| | | |
|---|---|---|
| 2216960 | 4/1977 | Fed. Rep. of Germany . |
| 3242318 | 6/1983 | Fed. Rep. of Germany . |
| 18821 | 5/1973 | Japan . |

OTHER PUBLICATIONS

Kroger, Gerhard; Yarn-length Measuring Device for Winding Frames; Siemens Review XXXVI (1969) No. 5 (Federal Republic of Germany); pp. 197-202.

*Uster Rotordata,* A Publication of the Zellweger Uster Ltd. Company (printed in Switzerland, copyright 1983; 21 pages).

*Primary Examiner*—Stanley N. Gilreath

*Attorney, Agent, or Firm*—Michael J. Striker

[57] ABSTRACT

An apparatus for controlling the effective length of thread wound into a thread package during a winding operation includes a sensor which senses the rotation of a driving roller that drives the package being wound and issues signals representative of the number of revolutions, a divider which divides such signals by a divisor that is selectively adjustable by a user, and a counting arrangement which compares the output of the divider with the desired length of the thread wound into the package as selectively set into the counting arrangement by the user. At least one thread package wound to an actual length with the divisor adjusted to a known value is unwound under conditions that are anticipated to exist during the unwinding of the package by the ultimate user, and the effective length of the unwound thread is measured. The measured value is then used for adjusting the divisor of the divider in the event that the measured effective length deviates from the desired effective length. The operation of the counting arrangement is interrupted when there is encountered a break in the thread being wound.

6 Claims, 1 Drawing Figure

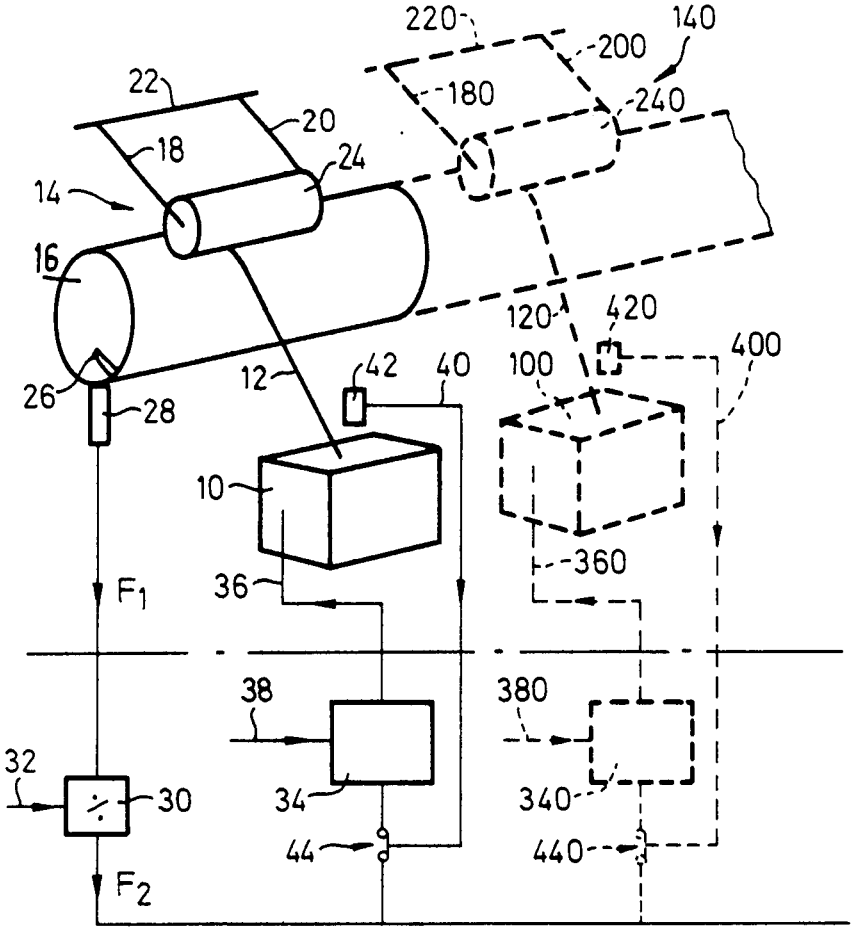
220
140
200
180
240
22
20
18
24
14
16
120
420
400
100
42
40
12
26
28
10
360
36
F1
38
380
32
30
34
340
44
440
F2

METHOD AND APPARATUS FOR CONTROLLING THE EFFECTIVE LENGTH OF THREAD PACKAGES

This is a continuation of application Ser. No. 893,562, filed Aug. 5, 1986, now abandoned, which in turn is a continuation of application Ser. No. 715,645, filed on Mar. 21, 1985, now abandoned.

BACKGROUND OF THE INVENTION

The present invention relates to the manufacture of wound thread packages in general, and more particularly to a method of and an apparatus for controlling the effective length of the thread wound into the respective package.

There are already known various arrangements for winding thread packages in yarn processing machines, among them such in which the package winding unit is so constructed that the package being formed is driven therein, preferably by frictional contact, by suitable driving means The present invention is intended primarily but not exclusively for use in a yarn processing machine that includes a plurality of yarn processing stations having independently operatable package winding units. Examples of such machines are rotor spinning machines, false twist texturizing machines, automatic back winding machines, air jet spinning machines, and friction spinning machines It is a common practice in the thread winding field to use a friction drive roller (or "drum") for rotating a thread or yarn package during a winding operation with the drive roller being in a frictional contact with the package being formed or wound. In multi-station machines, in which a plurality of operating stations is arranged end-to-end in a row, a single common drive roller or shaft may be used to function as the aforementioned friction drive roller for all of the stations in the row, or each of the stations in the row may be provided with its own individual, independently drivable and stoppable, friction roller.

Even in those machine constructions in which the friction drive rollers of a plurality of operating stations are constituted by portions of a single rotatable shaft or roller, the wind-up sections of the operating stations will normally be independently operatable in the sense that a winding operation at one of the stations of the row may be commenced and terminated without affecting the winding operations taking place at the other stations associated with the same drive shaft or roller. This can be achieved quite simply by selectively terminating the supply of yarn at the individual stations and/or, preferably, by moving the yarn package out of contact with the friction drive shaft or roller at the station in the row at which the winding operation is to be terminated.

There is in existence an increasing trend in the field of manufacturing or upgrading the machines of this type for providing such machines with length control systems for determining the length of the thread being wound into each individual package. In the German published application DE-AS No. 22 16 960, and in the U.S. Pat. No. 3,988,879, there are disclosed length control systems wherein pulses emitted by a pulse emitter responsive to the rotation of a friction drive roller are accumulated in counter means. An adjustably settable correction factor can be set into the counter means so as to adapt the variable actual pulse count, which corresponds to the variable desired or required package length, to the capacity of the accumulator of the counting means, which capacity is limited or fixed. The aforementioned German application also suggests that the length of the thread wound per revolution of the drive roller or per pulse can be measured and used as input data in the calculation of the required setting for the adjustable counter.

It is also well known that friction drive systems suffer from the problem of slippage at the region of contact between the drive roller and the package being wound. Accordingly, the length of the thread wound per revolution of the drive roller depends not only on the diameter of the drive roller, but also on the degree of slippage between the drive roller and the package. This degree of slippage may vary during any individual winding operation, for instance, with an increasing pressure of the package being built up at the winding station. Furthermore, the degree of slippage may vary between successive winding operations if, for example, there is a change of the thread material between such successive operations, so that the friction conditions encountered at the contact region between the drive roller and the package being wound change accordingly.

A solution to this problem has been proposed in the published German patent application DE-OS No. 32 42 318. This system involves a continuous estimation of the degree of slippage during a winding operation. This estimation is then being used for modifying a signal which is representative of the rotation or the friction drive roller, so that the modified signal more accurately represents the wound length of the thread in the thread package. However, the system disclosed in this published application is quite complex and therefore too expensive to put into practicle operation. Furthermore, it can take into account only slippage, while other factors can also affect the "effective length" of a thread package during the uwinding of the latter, as will be further described later on in this specification.

While the system disclosed in the German patent application No. 22 16 960 could be so operated as to allow for the slippage and other factors which are present in the package drive system and influence the winding of the thread into the package, it is not specifically designed for that purpose and, therefore, it is not convenient to use by the machine operator or user, and is not particularly suited for use with equipment that handles data relating to the length of the thread being wound into the thread package.

SUMMARY OF THE INVENTION

Accordingly, it is a general object of the present invention to avoid the disadvantages of the prior art.

More particularly, it is an object of the present invention to provide an arrangement for controlling the length of a thread wound into a particular package, which does not possess the above-enumerated and other disadvantages of the known arrangements of this type.

It is still another object of the present invention to construct the arrangement of this type as to be capable of correction or compensation for length variation factors occuring in a length control system of a yarn wind-up arrangement during the winding operation.

Yet another object of the present invention is to design the arrangement of the type here under consideration as to be able to take into account the various conditions under which the thread is unwound from the package.

A concomitant object of the present invention is to develop an arrangement of the above type which is simple in construction, relatively inexpensive, easy to use, and reliable in operation nevertheless.

In pursuance of these objects and others which will become apparent hereafter, one feature of the present invention resides in a yarn winding apparatus which comprises means, preferably a friction drive roller, for rotating a yarn package during a winding operation. Means is provided for producing an output signal which is a controllably adjustable function of the rotation of a part of the rotating means, preferably of the roller. Furthermore, adjustably settable means is provided for receiving the output signal of the producing means and for providing a winding termination signal when a predetermined rotation of the part has accumulated during a given winding operation. The relation between the rotation of the part and the effective length of thread wound can be allowed for by adjustment of the signal producing means.

The invention further provides a method of producing thread packages of substantially predetermined effective lengths by means of a wind-up device comprising a package drive and a package length control device adjustably responsive to the rotation of a part of the drive and also settable to terminate the winding operation after a predetermined rotation of the part. The method comprises the steps of adjusting the length control device to respond in a predetermined manner to the rotation of the part and setting the device to terminate winding after the completion of packages of a desired length, measuring the length of thread which can be unwound from at least one package produced with the device adjusted and set in this manner, and readjusting the device if necessary.

The novel features which are considered as characteristic of the invention are set forth in particular in the appended claims. The improved apparatus for controlling the effective length of thread packages itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The sole FIGURE of the accompanying drawing is a diagrammatic perspective view of a thread wind-up arrangement and an associated length control system.

DETAILED DESCRIPTION OF THE PREFERRED EMBODIMENTS

Referring now to the drawing in detail, it may be seen that it illustrates in solid lines a winding and length control arrangement for elongated formations, especially yarns, while another such arrangement is illustrated in dashed lines. The principles involved will first be described with reference to the portion of the drawing illustrated in the solid lines. Such principles will then be extended to a system incorporating a modification illustrated in dash lines. The illustrated winding and length control arrangement is suited for use in any of the machines mentioned in the introductory part of this specification, and also in other types of machines which will not be dealt with here in detail.

In the drawing, the portion above the dash-dotted line diagrammatically illustrates a yarn handling or processing part of the arrangement, that is, the predominantly mechanical aspects of the system. The portion of the drawing below the dash-dotted line depicts length control elements, that is, the predominantly electrical circuitry portions. The division is arbitrary and purely for convenience of organization of the following description, since, in operation, the mechanical and electrical features are interdependent.

The portion of the drawing shown in solid lines may be assumed to represent one yarn-processing station of a multistation machine. A main yarn processing unit is indicated diagram matically by a box 10 and a yarn leaving this unit is indicated a 12. The processing unit 10 can, for example, be a spinning unit (for example a rotor, jet or friction spinning unit) or a back winding unit or a false twist texturizing unit. The yarn 12 leaving the unit 10 is passed to a wind-up device generally indicated by the reference numeral 14. The processing unit 10 will be assumed herein to be a spinning unit.

The wind-up device 14 comprises a drive roller 16 which is cylindrical and is rotatable about its own longitudinal axis in a known manner that is not shown. Suitable, controllable drive means of a conventional construction (not shown) is provided to rotate the drive roller 16 at a desired rotational speed. Such drive means will be referred to again later in the specification, but the invention does not require any specific form of the roller 16 or of the drive means. The wind-up device 14 further comprises a conventional construction of a package cradle comprising a pair of arms 18 and 20 respectively connected to a carrier (not shown) for joint angular movement about a common carrier axis 22. At their ends remote from the carrier, the arms 18 and 20 carry between them, in use, a bobbin tube diagrammatically indicated at 24.

During a winding operation, the arms 18 and 20 can be pivoted to bring the tube 24 into frictional contact with the rotating roller 16 so that the tube 24 is rotated about its own longitudinal axis. The thread 12 passing to the wind-up device 14 is secured to the tube 24 by any suitable means (not shown) and is drawn into a package forming on the tube 24 by rotation of the latter due to contact of the tube 24 or the package with the drive roller 16. A suitable traverse mechanism (not shown) of a conventional construction is provided in the wind-up device 14, being operative to traverse the thread 12 longitudinally of the bobbin tube 24 so as to enable build-up of a yarn package of the desired form.

The construction of the wind-up device 14 mentioned above is fully conventional and examples of such devices can be found in U.S. Pat. Nos. 3,942,731; 3,356,306; and 4,352,466.

The roller 16 is provided with an indicator element 26 which rotates with the roller 16. A detector 28 is arranged near the periphery of the roller 16, and responds to the passage of the indicator element 26 to produce one output pulse per revolution of the roller 16. The output signal from the detector 28 is, therefore, a series of pulses at a pulse rate F1 which is a function of the speed of rotation of the roller 16.

The output signal from the detector 28 is fed to a divider indicated diagrammatically at 30, which produces an output signal having a pulse rate F2 where $$\frac{F_1}{F_2} = K > 1$$

The value of K is settable by suitable adjusting means acting on the divider 30 by way of an adjusting input 32.

While the thread 12 is being wound into a package in the wind-up device 14, the pulse output of the divider 30 is passed to a counter 34. The counter 34 is set to accumulate a predetermined pulse count, representing a desired length of the thread or yarn 12 wound into a package at the wind-up device 14, and then to issue a winding termination signal which is passed to the spinning unit 10, as indicated by a line 36 in the drawing. The count which has to be accumulated before the issuance of the winding termination signal is adjustable within a predetermined range by adjusting means (not shown) acting on the counter 34 via a control input 38.

The counting of pulses to indicate the length of thread wound into a package is now standard practice in the yarn processing industry, and no attempt has been or will be made to explain all aspects and details of such a system in this description. Means is provided for starting the pulse accumulation in the counter 34 at the beginning of a given winding operation, and accumulation continues until that particular winding operation is complete, as represented by the accumulation of the preset number of pulses. However, the accumulation must be interrupted when the winding operation is interrupted. This is indicated purely diagrammatically in the drawing by a link 40. This link 40 extends from a thread monitor 42 provided between the spinning station 10 and the wind-up device 14 to a switch 44 situated between the divider 30 and the counter 34. The switch 44 is closed while the thread 12 is being supplied from the unit 10 to the wind-up device 14, and is open when the monitor 42 indicates an interruption of such supply. It is to be emphasized here that the interrupting system as illustrated is a relatively primitive one which is included merely for purposes of illustration of the principles involved. A more complex system will be described later, but neither system forms an essential feature of the present invention.

Assume now that the machine user wishes to produce packages which, when subsequently unwound, will give a predetermined ("effective") length of the thread 12, for example 100 km. To achieve this, the user enters "100 km" at the control input 38 of the counter 34 and an input device of a known construction incorporated in the input 38 automatically converts this length data into a predetermined accumulation pulse count (set count) which is set in the counter 34. The user has, at this stage, no reliable information regarding the slip conditions which will be encountered between the drive roller 16 and the packages he wishes to produce, or other factors which may affect the effective thread length in the package. He therefore enters "100%" at the adjusting input 32; the significance of this entry, the form of which is purely arbitrary, will be explained in the following paragraphs.

For the purposes of this explanation, it is convenient to convert the pulse rates referred to above into pulses per unit length. Assume that the detector 28 emits one pulse per revolution of the roller 16. N pulses will then be emitted by the detector 28 during a winding operation in which N revolutions of the roller 16 are needed to produce a package of the effective length of L meters, counting only those revolutions which occur while the thread 12 is being drawn into the package, i.e. excluding interruptions. Assuming constant roller speed, the pulse count (SC) set into the counter 34 by the entry of "L" meters at the input 38 must be given by SC=N/K. The divisor K can be defined by $$K=C.Ks$$

where C is a length adjustment coefficient (expressed as a percentage) entered at the input 32 and Ks is a fixed "base divisor" given by F1/F2 when C=100%. Ks is determined in dependence upon the storage capacity of the counter 34, the anticipated range of speeds of the roller 16 and the required accuracy of the length measurement (higher required accuracy requires more pulses per given number of revolutions).

The pulse count SC set into the counter 34 is a predetermined linear function of L and is determined, as mentioned above, by the input or translation device built into the data or control input 38. The user thus enters the desired length L as described above and the translation device converts this into the corresponding pulse count, setting SC in accordance with the predetermined translation function.

Now, the above assumed entry of the adjustment coefficient C=100% at the adjusting input 32 sets K=Ks and represents an assumption that no length variation factors are in effect, that is, an assumption that the desired effective package length L will be produced by L/#D revolutions of the drive roller 16, where D is the diameter of the roller 16. This assumption is, however, very unlikely to prove to be correct and the resultant packages will almost certainly not pay out the desired length L of the thread 12 during unwinding.

One reason for this is the slippage discussed in the German Patent Specification No. 3242318. Such slippage in the contact region between the roller 16 and the package will tend to produce a package which has an actual thread length shorter than the desired length L, with an adjustment coefficient of 100%.

A second reason is that the package is wound with a certain tension being applied to the yarn 12 as it is drawn into the package. The yarn 12 is therefore elastically stretched to a degree dependent upon its own structure and the winding tension applied. During unwinding, however, the yarn 12 will be subjected to totally different tension conditions which will be dependent upon the type of unwinding operation involved. The yarn 12 may therefore relax during unwinding, so that the effective package yarn length is still shorter. The yarn 12 may, however, be stretched still more during unwinding, in which case its effective length may appear long relative to the corresponding roller rotation. The yarn manufacturer (machine user) therefore has to ascertain the conditions under which the respective packages will be unwound before he can assess the error introduced by the C="100%" adjustment at the adjusting input 32.

To determine the effective lengths of the yarn or thread 12, the machine user takes sample packages and unwinds them under the aticipated operating or unwinding conditions while applying a suitable length measuring technique to measure the effective length of the thread in each sample package. This renders it possible to estimate an average percentage error; for example, the average measured package length may be found to be only 98% of the set length ( i.e. 98 km in the example chosen above). Preferably, of course, a plurality of the packages is measured in this way to give a statistically reliable error estimation.

The divisor K is now adjusted at the input 32 in accordance with the error measured as described above. The actual entry to be made at the input 32 is dependent upon the capabilities of the input device and the correction format adopted. If the input device is appropriately designed, the user may, in the assumed example, enter 98% ( i.e. the actual measured effective length) and the input device will convert this data to an appropriate correction of the divisor K, in this case into an appropriate increase in K with a corresponding increase in the number of pulses N (revolutions of the roller 16) required to reach the set count SC. Alternatively, the required increase in K may be calculated by the user and the thus calculated value may be entered as such at the input 32, in which case the input device at the input 32 can be made simpler.

It will be apparent that the designation "100%" for the "ideal" condition is purely arbitrary; any other designation could be used for the same purpose and the data entering device associated with the input 32 could be adapted accordingly.

For simplicity of the explanation, the description so far has assumed that the wind-up device 14 has its own individual drive roller 16 and its own individual counter 34. Individual drive rollers 16 are commonly used in back winding machines where the termination of the winding operation is effected by terminating the drive to the drive roller 16. In spinning machines, however, it is more common to use a drive shaft extending over the full length of the machine and constructed as a friction roller 16 common to all spinning positions or stations on at least one machine side (two such rollers are provided in a double-sided machine). This is indicated by the dashed line extension of the shaft or roller 16 in the drawing. Each spinning position then has its own individual wind-up device and spinning unit; spinning and winding can be terminated at any individual position or station without affecting operations at any other position or station, for example by discontinuing the feeding of fiber material to the spinning position or station where the spinning is to be terminated, and preferably by lifting the package at that position or station away from the drive shaft or roller 16.

Since the parts and components of the additional positions or stations are as far as possible identical to those of the first-described spinning position or station, they have been indicated for one such additional station that is shown in the dashed line portion of the drawing by reference numerals ten times larger than those identifying the corresponding parts or components in the solid line portion of the drawing.

In a modern multi-station machine (whether a winding machine, a spinning machine or a texturizing machine), the individual stations would almost certainly not be directly connected to their respective counters 34, 340 etc. by individual leads as illustrated in the drawing. A data transmission system using sampling and multiplexing techniques would be used to transmit the required basic data from the individual operating stations to a central monitoring unit. Such systems are already commercially available, for example, from Zellweger A.G. of Uster, Switzerland, and a suitable system is also described in a copending commonly owned U.S. patent application Ser. No. 715,722 filed on Mar. 21, 1985, the disclosure of which is hereby incorporated in the present specification by reference. Since this data transmission system does not form a part of the present invention, its details have been omitted from the present specification.

The data transmission system forms a part of a data processing system which enables presentation of operating data "on-line" to the mill management. It is, therefore, associated with read-out equipment enabling read-out on demand and/or at intervals of data stored in the register of the data processing system. The "counters" 34, 340 etc. may then be constituted by a suitable length storage register with individual cells corresponding to individual operating stations. Each cell stores data representing the effective length of the package currently being wound at its associated station. The data processing system can include still other registers containing data representative of the total effective length of yarn produced by the machine over a given period. This can be compared with the total theoretically possible output of yarn over the same period, giving a measure of the efficiency of operation of the machine. This description gives an outline only of the type of data available from such systems; many other features related to yarn length can also be provided, for example a number of thread breaks per unit length (say 1000 m) of yarn produced.

The advantages of the present invention are particularly apparent when it is used in combination with such a system. Let us consider now an alternative length correction system, in which the divisor at the unit 30 is fixed and the desired length correction is achieved by entering a "false" setting for the pulse count at the counter 34 e.g. by entering 102 km when a package of 100 km is required. Apart from the risk of confusion in operating the machine, which could, however, be dealt with by entering and displaying both a "true" set length and a corrected (or "false") set length, there is the disadvantage that only the zero and the final package length values extracted by the data processing system would be correct and all of the intermediate values derived from the rotation of the friction roller during a winding operation would be false.

In accordance with the present invention, on the other hand, the output of the pulse producing means (represented by roller 16, the pulse generator 28 and the divider 30 taken together) is corrected for each revolution of the roller 16. The same effect could, of course, be achieved in theory by adjusting the number of pulses emitted by the detector 28 per revolution of the roller 16, for example by using a different number of the indicator elements 26 on the roller 16. This is, however, unlikely to prove to be a really practical alternative to the adjustable modification by the divider 30 of the output of the signal generator 28 which responds directly and in a predetermined manner to the rotation of the roller 16. As indicated in the introductory part of this specification, the system described in the published German patent application No. DE-AS 2216960 could also be operated to put the method according to the present invention into effect. In that case, however, there is only a single adjustment possibility since the capacity of the storage device corresponding to the counter 34 in the present application is fixed. However, in the arrangement of this published application , the user must adjust the dividing factor so as to take into account both the error effect and the fixed capacity of the count storage device. The apparatus according to the present invention, on the other hand, by providing both an effective length setting and a correction adjustment, is more flexible, less prone to the risk of error and thus more convenient for the machine user.

The invention is not limited to friction drives. As indicated above, length variation factors may be unrelated to slippage in the drive system and, accordingly, the present invention may be useful even where such slippage is effectively prevented, e.g. in spindle-driven wind-up devices.

The drawing illustrates the most economical embodiment in which the single pulse generator 28 and the divider 30 deliver pulses to a plurality of processing stations. This is, of course, only possible where the drive roller 16 is common to those stations. Even in that case, additional modifications are possible at the cost of added complexity and expense, for example, a single pulse generator such as 28 could feed plurality of dividers such as 30 respectively associated with the individual processing stations, thus enabling the use of correction coefficients individual to the stations. In this case, the correction coefficients could be variable according to a predetermined function over the course of the winding operation. For this purpose, a signal could be derived in response to the state of the individual counter 34 so as to cause continuous or stepped variation of the associated correction coefficient.

From the foregoing description, it will be understood that the "effective" length of a thread package is dependent upon the circumstances of use, in particular upon the conditions under which the package has been produced (wound) and those under which it will be used (unwound) in the next processing stage. There is no "absolute" length of the thread in a package; the "effective" length must be determined in practice from case to case.

It will be understood that each of the elements described above, or two or more together, may also find a useful application in other types of arrangements differing from the type described above.

While the invention has been illustrated and described as embodied in a thread package winding arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. A yarn winding apparatus comprising means for rotating a yarn package during a winding operation; means for producing an output signal which is a function of the rotary motion of a predetermined part of said rotating means during the winding operation; adjustably settable means for receiving said output signal and for providing a winding termination signal when the cumulative rotary motion of said predetermined part of said rotating means during the respective winding operation as indicated by said output signal has reached a predetermined level; and means separate from said adjustably settable means and operative for controllably adjusting said output signal prior to reaching said adjustably settable means to correct any deviation between the actual and the desired effective length of the yarn wound into the package.

2. The apparatus as defined in claim 1, wherein said rotating means includes a rotating drive member which is in a frictional contact with the respective yarn package during the winding operation involving the latter for driving the same in rotation.

3. The apparatus as defined in claim 1, wherein said predetermined part of said rotating means is a friction roll contacted by the respective yarn package during the winding operation involving the latter.

4. The apparatus as defined in claim 1, wherein said output signal producing means includes a signal producing device responsive to the rotary motion of said predetermined part of said rotating means, and a signal modifying device which is controllably adjustable to modify the signal produced by said signal producing device.

5. The apparatus as defined in claim 4, wherein said signal producing device is a pulse generator, and said signal modifying device is a divider.

6. A method of producing thread packages of predetermined effective lengths utilizing a winding arrangement that includes a package drive and a package length control device adjustably responsive to the rotary motion of a predetermined part of the package drive and also settable for causing the termination of the package winding operation when the cumulative rotation of the predetermined part during the winding operation has reached a predetermined level, comprising the steps of adjusting the package length control device to respond in a predetermined manner to the rotation of the predetermined part and to form a signal representative of such rotation; setting the package length control device separately from and in addition to the adjustment accomplished during said adjusting step for terminating the winding operation in response to said signal upon the completion of the package of a predetermined length; measuring the effective length of the thread which can be unwound from at least one package produced with such adjustment and setting; and changing the adjustment accomplished during said adjusting step if the measured effective length deviates from that desired to correct such deviation in subsequent packages by changing the manner in which the package length control device responds to the rotation of the predetermined part in forming said signal from the predetermined manner to a modified manner while maintaining the setting obtained during said setting step.

* * * * *